US005502475A

United States Patent [19]

Kaburagi et al.

[11] Patent Number: 5,502,475

[45] Date of Patent: Mar. 26, 1996

[54] INK JET RECORDING APPARATUS PROVIDED WITH FIXATING MEANS

[75] Inventors: Yoshiaki Kaburagi, Tokyo; Shoichiro Shoda, Yokohama; Tetsuo Kimura, Sagamihara; Yoji Ara, Yokohama; Takanori Mukai, Naka; Masaaki Nakamura, Toyonaka; Katsuyuki Yokoi, Yokohama, all of Japan

[73] Assignee: Canon Kabushiki Kaisha, Tokyo, Japan

[21] Appl. No.: 288,810

[22] Filed: Aug. 12, 1994

Related U.S. Application Data

[63] Continuation of Ser. No. 186,504, Jan. 26, 1994, abandoned, which is a continuation of Ser. No. 106,197, Aug. 13, 1993, abandoned, which is a continuation of Ser. No. 829,594, Feb. 3, 1992, abandoned, which is a continuation of Ser. No. 559,979, Jul. 30, 1990, abandoned, which is a continuation of Ser. No. 441,210, Nov. 30, 1989, abandoned, which is a continuation of Ser. No. 324,819, Mar. 17, 1989, abandoned.

[30] Foreign Application Priority Data

| | | | |
|---|---|---|---|
| Mar. 18, 1988 | [JP] | Japan | 63-65090 |
| May 19, 1988 | [JP] | Japan | 63-120678 |
| Jul. 19, 1988 | [JP] | Japan | 63-179828 |

[51] Int. Cl.[6] ..... B41J 2/01; B41J 29/00

[52] U.S. Cl. ..... 347/102; 347/16; 219/216; 34/549; 34/618

[58] Field of Search ..... 347/102, 16; 219/216; 101/424.1; 346/25; 34/482, 549, 618

[56] References Cited

U.S. PATENT DOCUMENTS

| | | | |
|---|---|---|---|
| 3,588,445 | 6/1971 | Hopkins | 346/25 X |
| 4,469,026 | 9/1984 | Irwin | 347/102 X |
| 4,661,824 | 4/1987 | Kuge | 346/25 X |
| 4,723,129 | 2/1988 | Endo | 347/56 |

FOREIGN PATENT DOCUMENTS

| | | | |
|---|---|---|---|
| 0307251 | 3/1989 | European Pat. Off. | B41J 29/00 |
| 2716705 | 10/1978 | Germany . | |
| 84670 | 6/1980 | Japan . | |
| 188685 | 11/1983 | Japan | B41J 27/00 |
| 62-130863 | 6/1987 | Japan | B41J 29/00 |
| 63-98474 | 4/1988 | Japan | B41J 29/00 |

OTHER PUBLICATIONS

Ink Jet Dryer With Individually Actuable Elements, Xerox Disclosure Journal, vol. 7, No. 5, Sep./Oct. 1982, pp. 317–318.

Ink Dryer For Ink Jet Printer, Research Disclosure No. 185, Sep. 1979, pp. 472–473.

*Primary Examiner*—Joseph W. Hartary
*Attorney, Agent, or Firm*—Fitzpatrick, Cella, Harper & Scinto

[57] ABSTRACT

An ink jet recording apparatus has means for heating a recording medium guide member disposed near the ink recording area by a recording head for discharging ink, and means for changing the rate of heat imparted to the unit length of the recording medium with respect to the direction of conveyance thereof by the heating means in conformity with a parameter changing the environmental condition of the ink recording area.

25 Claims, 12 Drawing Sheets

INK JET RECORDING APPARATUS PROVIDED WITH FIXATING MEANS

This application is a continuation of application Ser. No. 08/186,504 filed Jan. 26, 1994, now abandoned, which is a continuation of application Ser. No. 08/106,197 filed Aug. 13, 1993, abandoned, which is a continuation of application Ser. No. 07/829,594 filed Feb. 3, 1992, abandoned, which is a continuation of application Ser. No. 07/559,979 filed Jul. 30, 1990, abandoned, which is a continuation of application Ser. No. 07/441,210 filed Nov. 30, 1989, abandoned, which is a continuation of application Ser. No. 07/324,819 filed Mar. 17, 1989, abandoned.

BACKGROUND OF THE INVENTION

1. Field of the Invention

This invention relates to an ink jet recording apparatus in which ink is discharged in conformity with heat energy or pressure and droplets of the ink are used to effect recording, and can be used as a printer unit contained in a business instrument or a printer connected to the outside.

As typical instruments in which the present invention can be utilized, mention may be made of a copying apparatus, a facsimile apparatus, a printer for a personal computer, a printer for a large computer, etc.

2. Related Background Art

There are ink jet recording apparatuses based on the discharge principle that use the piezo type discharge principle, a state change is caused in liquid by rapid heating disclosed in U.S. Pat. No. 4,723,129, U.S. Pat. No. 4,740,796, the liquid is forced out in conformity with the state change to thereby accomplish recording (the bubble jet type). This bubble jet type has many advantages including excellence in performance when responding to a recording signal and therefore has come to be adopted in recent years.

Also, the ink record image by an ink jet recording apparatus has been fixated on a recording medium by natural desiccation. In recent years, however, in using various kinds of paper or transparent resin sheets for overhead projectors (hereinafter referred to as O.H.P. sheets) as the recording medium and using various kinds of ink, the problem of unsatisfactory fixation has arisen. As a solution to this problem, there is Japanese Laid-Open Patent Application Sho-60-110457. This publication discloses a technique whereby an O.H.P. sheet is detected and a heater (preferably used with a fan) near a platen roller is operated only in conformity with the detection signal to thereby improve the fixation of ink on the O.H.P. sheet.

On the other hand, U.S. Pat. No. 4,469,026 (corresponding to EP-PS 25878/1980 and Japanese Patent Publication Sho-62-33959) discloses a technique for controlling heat energy and the discharge speed of paper which are fixation conditions with a recording signal and the moisture absorbing state of paper as parameters.

However, according to U.S. Pat. No. 4,469,026, the heating area is situated far behind the recording area, and this patent does not bear the disclosure of a technique which pays attention to the recording area. Also, Japanese Laid-Open Patent Application No. Sho-60-110457 only bears the disclosure of fixation and does not bear the disclosure of the technique which pays attention to the recording area.

SUMMARY OF THE INVENTION

The present invention pays attention to the following phenomenon which has occurred when an attempt has been made to achieve the compactness of the apparatus by causing heating means for fixation to act on the recording area or in the vicinity thereof.

In the recording gap (e.g. 20 μm to 100 μm) between a recording head and a recording medium, the recording medium has been deformed to change the recording gap itself and unsatisfactory recording has been observed. It has also been observed that when the deformation of the recording medium becomes great, unfixated ink or the medium itself rubs against the recording head and unsatisfactory discharge is experienced and the discharge opening, as a unit of the recording head, is destroyed.

The present invention has been studied and developed to solve such a situation, and a primary object thereof is to achieve the stable use of the recording head itself, the stabilization of fixation and the mitigation of the deformation of the recording medium without disturbing the ink record image in the recording area.

Another object of the present invention is to provide an ink jet recording apparatus having means for heating a recording medium guide member disposed near the ink recording area by a recording head for discharging ink, and means for switching the rate of heat imparted to the unit length of the recording medium with respect to the direction of conveyance thereof by said heating means in conformity with a parameter changing the environmental condition of the ink recording area.

Therefore, the present invention pays attention to conditions which cause unnecessary environmental fluctuation of the recording area, and appropriately changes the amount of heat energy applied to the unit length of the recording medium, thereby achieving the above objects.

In the present invention, parameters which change the environmental condition of the recording area include the staying time of the recording medium which causes a change in the recording medium, the amount of change in the temperature of the recording head concerned with the discharge of a great amount of ink, the thickness of the recording medium, the amount of moisture absorbed by the recording medium, and a combination thereof.

DESCRIPTION OF THE PREFERRED EMBODIMENTS

Figure 1:
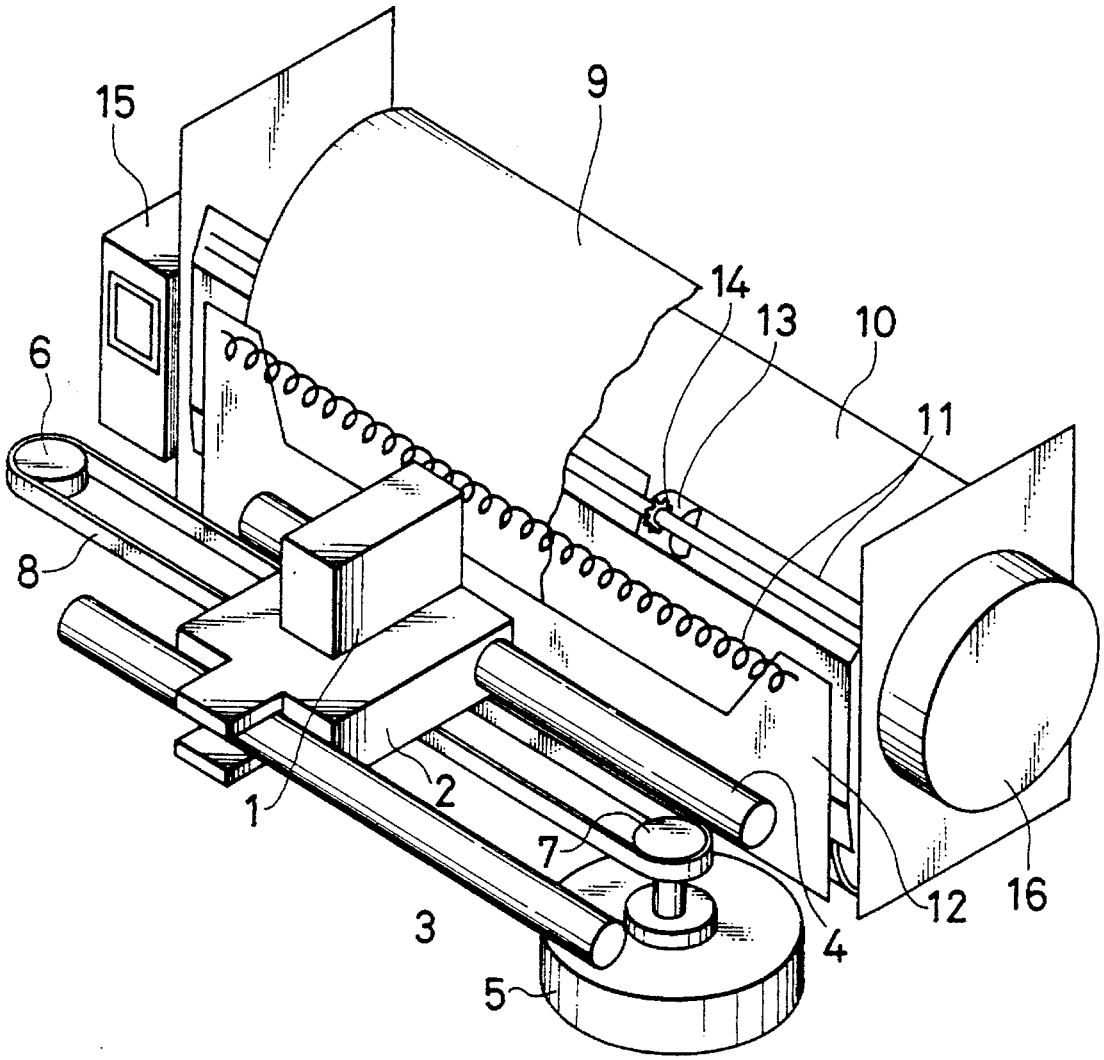
FIG. 1 is a pictorial view showing the printing unit of an ink jet recording apparatus to which a heater temperature control unit according to the present invention is applied.

Before some embodiments of the present invention are described with reference to the drawings, the essential portions thereof will be described.

A first embodiment group solves the problem that occurs when a recording area close to a recording head continues to be warmed at a set temperature, for example, in the range of 60° C. –80° C., a sheet is deformed (and further, discolored) by the heat when the sheet is in contact with a heater for a long time while waiting for printing as during off-line and during the waiting for a printing command, and, particularly the, problem when the environment is at a high temperature, water content is rapidly evaporated by the heater, whereby the sheet contracts and is greatly deformed to cause print deviation in the direction of the column and, further, results in bad sheet feed such as sheet jam or the like.

A second embodiment group is an embodiment which provides an inexpensive liquid jet recording apparatus of simple construction which can set a heating temperature that the fixation of recording liquid droplets to a recording sheet becomes optimum for the difference in the fixativeness of the recording sheet by the thickness of the sheet, the condition of the surface of the sheet or the like and the environment, and which can minimize the deformation and discoloring of the recording sheet caused by heating means.

A third embodiment can solve even the problem that if a sheet is fed while the ink thereon does not sufficiently dry up, the sheet contacts with a sheet conveying guide portion and is stained thereby, and in this embodiment, any temperature rise, during recording, of a recording head in which a heater provided on the wall surface of the nozzle of the recording head is electrically energized to heat the ink in the nozzle to thereby produce a bubble in the nozzle and discharge the ink is detected, and the fixation time on the heater is varied in conformity with the value of the temperature rise, whereby necessary and sufficient fixation of the ink can be accomplished.

As the first embodiment, there is, for example, in a case where the set temperature of the heating means near the recording area is 80° C. or below, unsatisfactory discharge of some of the ink in the recording head is experienced during the downtime for a unit of seconds on the order of several seconds (one to five seconds), the set temperature is reduced with the unit of seconds as the reference to thereby solve the inconvenience, or, for example, in a case where the recording medium is stopped for a unit of minutes on the order of several minutes (two to four minutes) without recording being effected, deformation and discoloring of the recording medium is encountered, the set temperature is reduced with the unit of minutes as the reference or the heater is turned off.

As the third embodiment, there is supposed an example in which in spite of the recording head being adjusted in temperature, the normal one-line sheet feeding speed (e.g. 150 mm/line) is slowed down to half or below (e.g. 300 mm/line) in conformity with a sudden temperature rise (the temperature rise during solid printing, as compared with the temperature rise during normal printing being 2° C. or 3° C., is of the order of 5° C. to 10° C.).

The above-mentioned numerical values are on the premise that the width of the heating area with respect to the direction of sheet feeding is 3 cm to 5 cm (which usually corresponds to five or six lines), and are more or less changeable by changing the design of the heating area. The present invention is not restricted to these embodiments, but covers all that which is included in the above-described technical idea.

The present invention will hereinafter be described with reference to the drawings.

The present invention will hereinafter be specifically described with reference to FIGS. 1 to 4.

Figure 2:
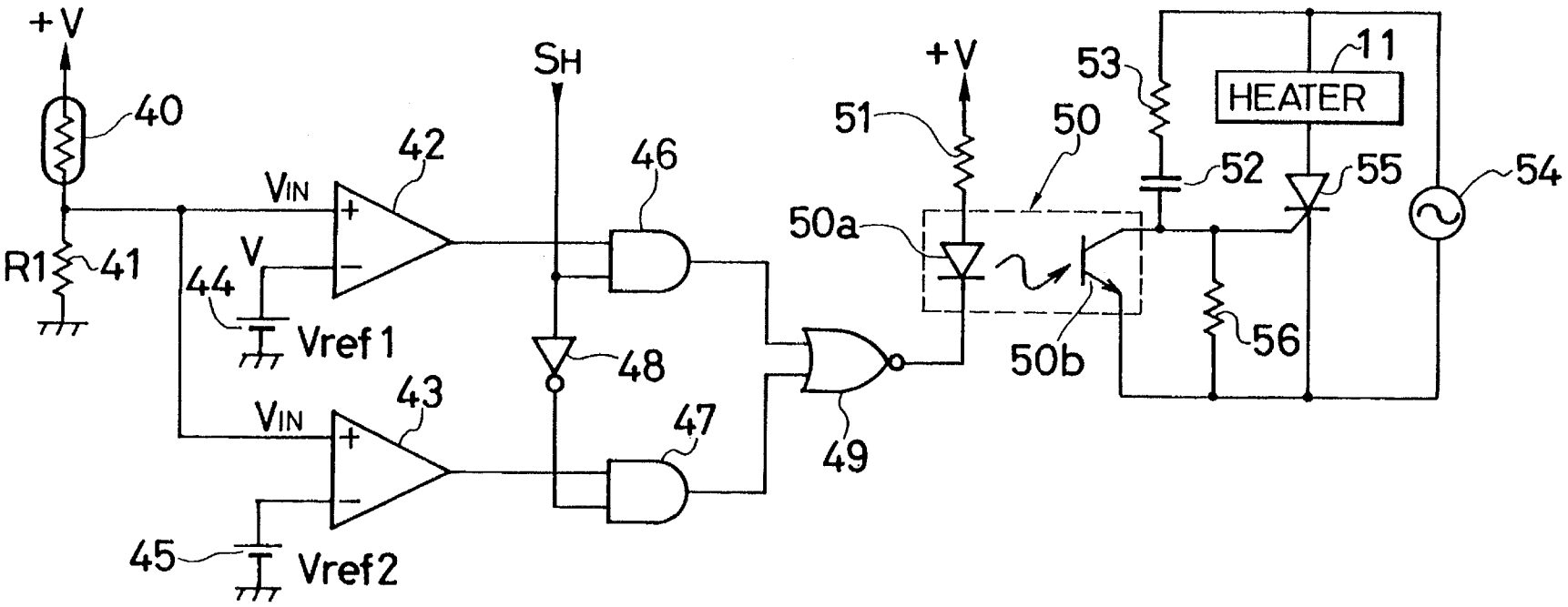
FIG. 2 is a circuit diagram showing a control system according to a first embodiment of the present invention.
Figure 3:
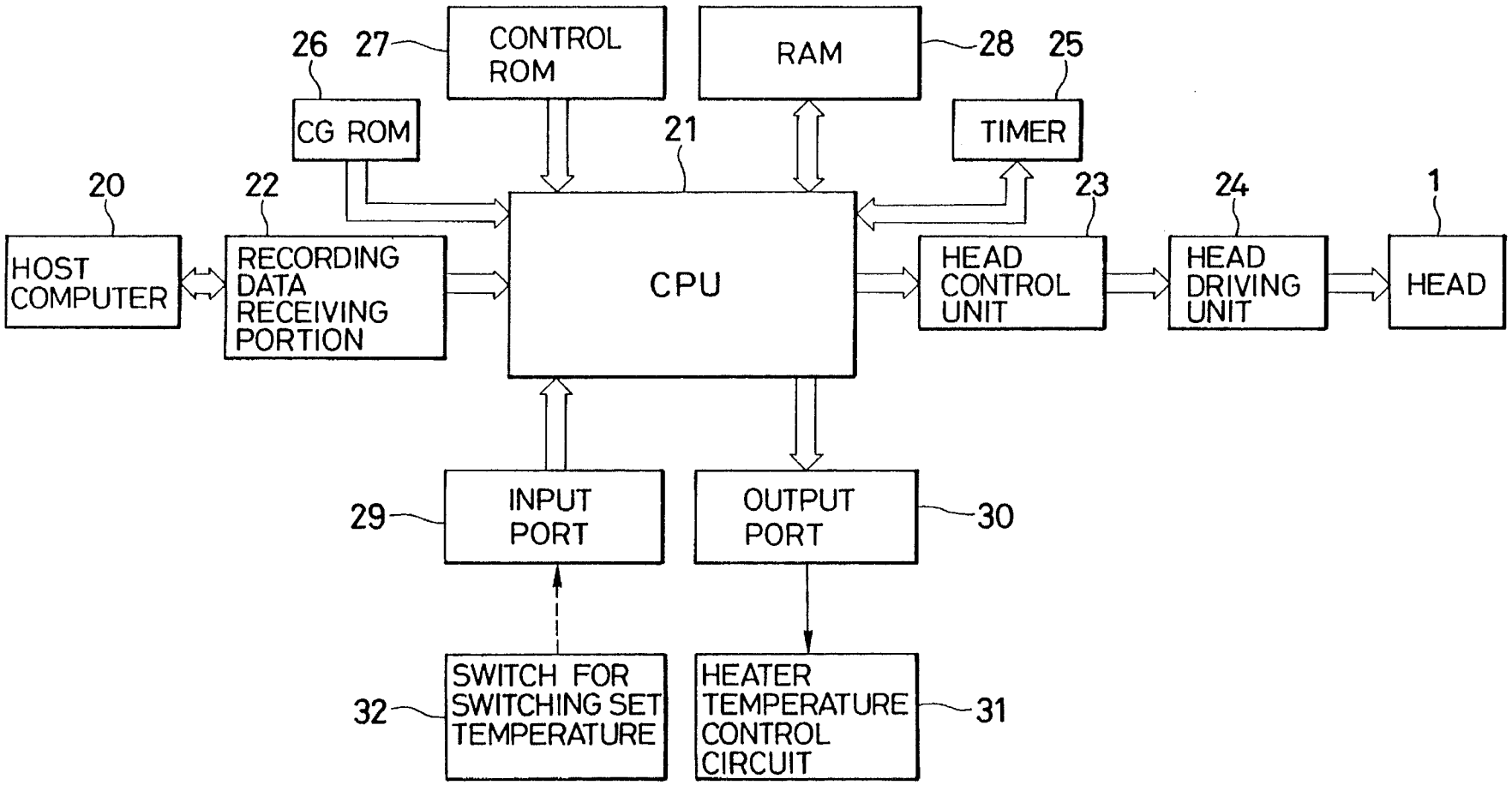
FIG. 3 is a block diagram showing the control system of the apparatus of FIG. 1.
Figure 4:
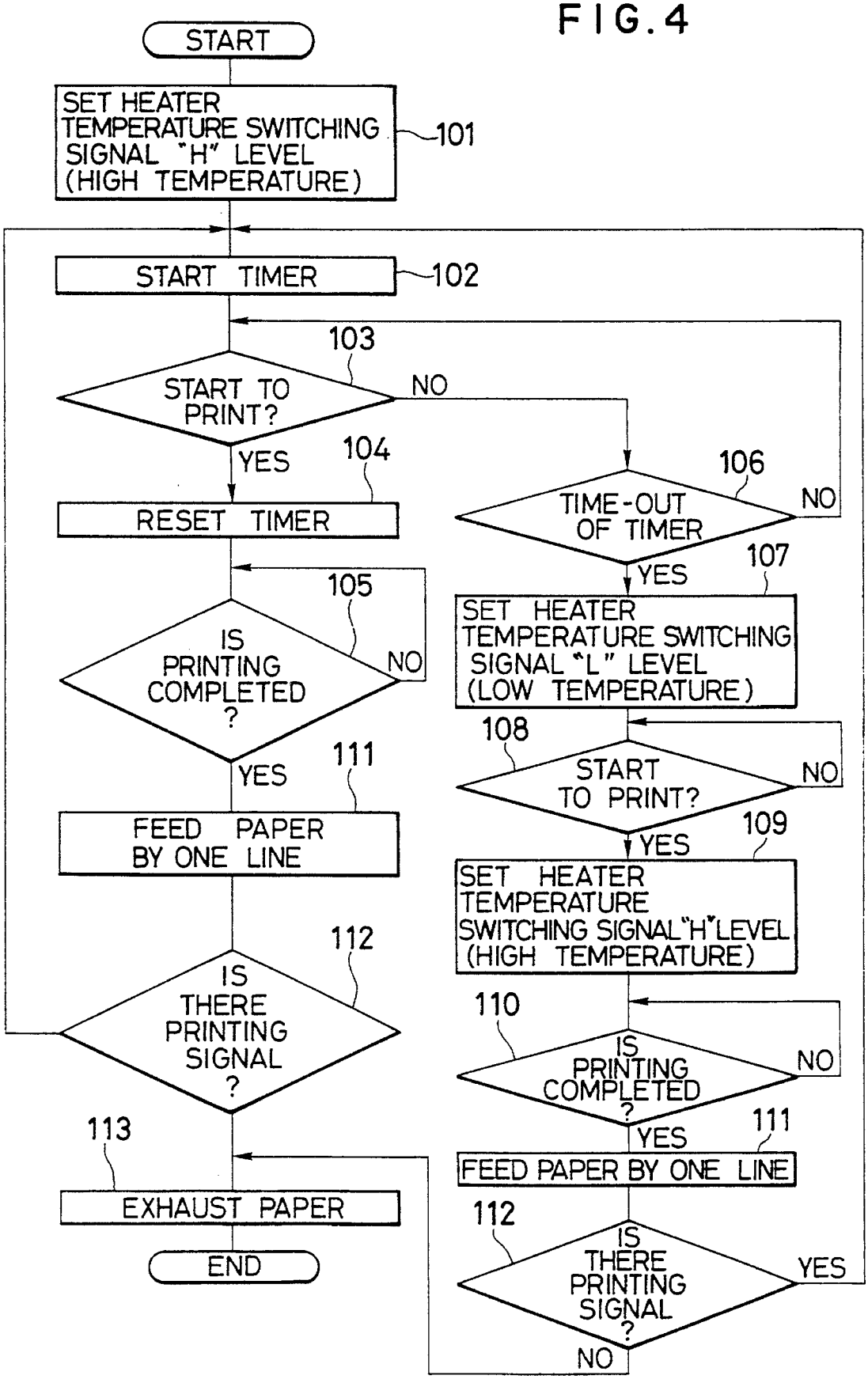
FIG. 4 is a flow chart showing the control content of the heater temperature control unit of FIG. 2.

FIG. 2 is a circuit diagram of a heater temperature control unit showing an embodiment of the present invention, FIG. 2 is a pictorial view showing the printing unit of an ink jet recording apparatus to which the heater temperature control unit according to the present invention is applied, FIG. 3 is a block diagram showing the control system of the apparatus of FIG. 1, and FIG. 4 is a flow chart showing the heater temperature control of the embodiment of FIG. 2.

Referring to FIG. 1, the reference numeral 1 designates a head for discharging ink, the reference numeral 2 denotes a carriage for reciprocally moving the head in the direction of recording, the reference numerals 3 and 4 designate guide shafts for movably supporting the carriage 2, the reference numeral 5 denotes a carriage motor which is a drive source for moving the carriage 2, the reference numeral 6 designates a pulley provided on the opposite side of the carriage motor 5, the reference numeral 7 denotes a pulley provided on the end of the shaft of the carriage motor 5, and the reference numeral 8 designates a timing belt suspended between the pulleys 6 and 7 and engaged with the carriage 2.

The reference numeral 10 denotes a paper pan for guiding the conveyance of a recording sheet 9, the reference numeral 11 designates a heater disposed along the paper pan 10, the reference numeral 12 denotes a paper keeping plate formed of an elastic material and, adapted to urge the recording sheet 9 against the heater 11, the reference numeral 13 designates a paper discharge roller for smoothly conveying the recorded recording sheet 9, the reference numeral 14 denotes a spur rotatable while bearing against the paper discharge roller 13, the reference numeral 15 designates a recovery unit for supplying ink to the nozzle (not shown) of the head 1 or removing foreign materials adhering to the nozzle and ink increased in viscosity to thereby restore the discharge characteristic to the normal state, and the reference numeral 16 denotes a paper feeding motor for rotating the paper pan 10.

In FIG. 1, the recording paper 9 inserted from the back of the lower portion of the paper pan 10 is fed to the front of the head 1 with the rotation of the paper pan 10. When a recording start command is put out, the carriage 2 is moved leftwardly to its inital position by the carriage motor 5. The carriage motor 5 then revolves in the reverse direction, and at the same time, the head 1 is driven in conformity with recording information, whereby the recording on the recording sheet 9 in the direction of a line (the widthwise direction of the sheet) is progressively effected by ink droplets flying from the nozzle of the head 1. In conformity with the progression of this recording, carriage 2 is moved rightwardly as viewed in FIG. 1. When the recording (printing) of one line is completed, the driving of the head 1 is discontinued and the carriage 2 is returned to its initial position by reverse revolution of the motor 5. At the same time, the motor 16 revolves and the recording sheet 9 is fed by an amount corresponding to the space of one line. Subsequently, recording of the next one line is executed in a manner similar to that described previously.

The construction of FIG. 3 will now be described.

In FIG. 3, the reference numeral 20 designates a host computer for generally controlling the recording apparatus and other terminal apparatuses, the reference numeral 21 denotes a CPU for controlling the ink jet recording apparatus of the present invention, the reference numeral 22 designates a recording data receiving portion for transmitting the recording data from the host computer 20 to the CPU 21, the reference numeral 23 denotes a head control unit for controlling the ink discharge of the head 1, the reference numeral 24 designates a head driving unit for driving the electrostrictive or magnetostrictive element of the head in accordance with the output of the head control unit 23, the reference numeral 25 denotes a timer connected to the CPU 21, the reference numeral 26 designates a character generator ROM for image processing, the reference numeral 27 denotes a control ROM for causing the CPU 21 to execute the control of each unit, the reference numeral 28 designates a RAM for storing received data and the result of processing therein, the reference numeral 29 denotes an input port to which an operation switch and a temperature detecting sensor are connected, the reference numeral 30 designates an output port connected to the CPU 21, and the reference numeral 31 denotes a heater temperature control circuit connected to the output port 30 to control the supply of electric power to the heater 11. In the construction of FIG. 3, the data to be recorded on the recording sheet 9 is transferred from the host computer 20 to the CPU 21 through the receiving portion 22. The CPU 21 drives the head 1 through the head control unit 23 and the head driving unit 24 on the basis of the transferred data. The driving timing of the head 1 is controlled by the set time of the timer 25.

Where the recording data transmitted from the host computer 20 are characters and symbols, the data are transferred in the form of a character code, and are converted into dot image data so as to be capable of being recorded by a dot matrix type head on the recording apparatus side. The program for this is stored in the character generator ROM (CG ROM) 26. Also, the CPU 21 normally introduces heater temperature detection information from the input port 29 thereinto, and the supply of electric power to the heater 11 is controlled by the heater temperature control circuit 31 so that the temperature value of the heater becomes the set temperature.

Description will now be made of the embodiment of FIG. 2 which corresponds to the heater temperature control circuit 31 of the construction shown in FIG. 3.

In FIG. 2, a thermistor 40 for measuring the surface temperature of the heater 11 and a resistor 41 (R1) are connected in series between a DC voltage source +V and the ground, and the positive input terminals of comparators 42 and 43 are connected between the junctions thereof. Reference voltage sources 44 and 45, outputting reference voltages Vref 1 and Vref 2, respectively, are connected to the negative input terminals of the comparators 42 and 43, respectively. One input terminal of each of AND circuits 46 and 47 is connected to the respective output terminals of comparators 42 and 43, and a heater temperature switching signal SH is input to the other input terminal of the AND circuit 46. The output terminal of an inverter 48 is connected to the other input terminal of the AND circuit 47, and the heater temperature switching signal SH provided by the output port 30 of FIG. 3 is applied to the input terminal of the inverter 48. This signal is normally at "H" level, and assumes "L" level when the recording sheet 9 is on the heater 11 for a predetermined time or longer.

A two-input NOR gate 49 is connected to the output terminals of AND circuits 46 and 47, and a photocoupler 50 is connected to the output terminal of the NOR gate 49. The photocoupler 50 is comprised of a light emitting element **50*a* such as an LED emitting a light during the conduction of the NOR gate 49 and a light receiving element 50*b* such as a phototransistor which supplies a photoelectrically converted current conforming to the intensity of the light of the light emitting element 50*a*. The light emitting element 50*a* has one end thereof connected to the DC voltage source +V through a resistor 51 (R2) and has the other end thereof connected to the output terminal of the NOR gate 49. Also, one end of the light receiving element 50*b* is connected to one terminal of an AC voltage source 54 through a capacitor 52 (C1) and a resistor 53 (R3), and the other end of the light receiving element 50*b* is connected to the other terminal of the AC voltage source 54. A serial circuit comprising the heater 11 and a thyristor 55 for controlling the supply of electric power to the heater 11 is connected between the terminals of the AC voltage source 54, and the output terminal of the light receiving element 50*b* is connected to the gate of the thyristor 55, and a resistor 56 (R4) for preventing the malfunctioning of the thyristor 55** is connected between said gate terminal and the ground.

In the construction of FIG. 2, the thermistor 40 has its internal resistance varied in conformity with the temperature sensed thereby and the voltage division ratio thereof to the resistor 41 is varied. The terminal voltage VIN of the resistor 41 produced in conformity with the heater temperature provides the input voltage of the comparators 42 and 43, and is compared with the reference voltages Vref 1 and Vref 2 of the reference voltage sources 44 and 45, respectively. The reference voltage Vref 1 is set so as to be VIN=Vref 1 at the set heater temperature T1 during normal application, and the reference voltage Vref 2 is set so as to be VIN=Vref 2 at the set heater temperature T2 when the recording sheet is on the printing platen for a predetermined time or longer (but T1>T2 and Vref 1>Vref 2).

When the heater temperature switching signal is at "H" level, the AND circuit 46 becomes operative, and when the heater temperature switching signal is at "L" level, the AND circuit 47 becomes operative. When the heater temperature is below the set temperature T1 during normal application, Vref>VIN and the outputs of the comparators 42 and 43 are both at "L" level. Accordingly, irrespective of the polarity of the heater temperature switching signal, the logic product of the AND circuits 46 and 47 is not established and the output of each of them is at "L" level. Therefore, the output of the NOR gate 49 is at "H" level and the NOR gate 49 is non-conductive and no electric current flows to the light emitting element **50*a*, and the gate circuit of the thyristor 55** is not closed.

At this time, a phase shift circuit provided by the resistor 53 and the capacitor 52 is connected to the gate of the thyristor 55 and therefore, an electric current advanced in phase with respect to the source voltage is applied to the gate and the thyristor 55 conducts for a positive half cycle of the AC voltage source 55 to supply electric power to the heater 11. Thereby the temperature of the heater 11 rises and with this rise, the resistance value of the thermistor 40 decreases.

When the temperature of the heater 11 exceeds the set temperature T1, the relation that VIN>Vref is created and the output of the comparator 42 turns to "H" level (at this time, the output level of the comparator 43 remains at "L" level). If at this time, the heater temperature switching signal is at "H" level, the logic product is established in the AND circuit 46 and the output thereof assumes "H" level. The NOR circuit 49 to which this output voltage is input turns its output from "H" level to "L" level. As a result, the NOR circuit 49 becomes conductive and causes the light emitting element 50*a* to emit a light. The light of the light emitting element 50*a* is received by the light receiving element 50*b* and the line between the gate of the thyristor 55 and the ground is short-circuited.

Thus the thyristor 55 is ceased to operate and the heater 11 is deenergized. Accordingly, the temperature of the heater 11 begins being reduced. VIN is compared with Vref 1 each time VIN increases or decreases in accordance with the temperature of the heater 11 and the output level of the comparator 42 varies in accordance with the level state thereof. Thus the temperature of heater 11 can be maintained a set temperature by repeating such controlling.

Next, CPU 21 determines whether the recording paper 9 remains on the heater 11 more than a predetermined time period without printing and paper feed, for example, during print waiting, and it switches the heater temperature switching signal to "L" level. Accordingly, the AND circuit becomes enabled, and AND circuit 47 is applied with "H" level signal through the inverter 48 and set to be able to operate. In this state VIN is compared with Vref 2. When the temperature of the heater 11 is higher than the set temperature T2, the output of the comparator 43 is at "H" level since VIN>Vref 2. Accordingly, the output of the AND circuit 47 becomes "H" level and the output of the NOR gate 49 becomes "L" level. As a result, the light emitting element 50*a* emits a light to render the light receiving element 50*b* conductive, and the gate circuit of the thyristor 55 is closed to completely cut off the supply of electric power to the heater 11. Accordingly, the temperature of the heater 11 falls gradually.

When the temperature of the heater 11 falls below the set temperature T2, the relation that Vref 2>VIN is established and the output of the comparator 43 turns from "H" level to "L" level to render the output of the AND circuit 47 into "L" level and render the NOR gate 49 into "H" level. Thereby the supply of electric power to the light emitting element 50*a* is cut off and the light emitting element 50*a* is turned off, and the internal resistance of the light receiving element 50*b* becomes infinitely great and an ignition signal is imparted to the gate of the thyristor 55 through the phase shift circuit to render the thyristor 55 conductive in a positive half cycle and supply electric power to the heater 11. In this manner, the thyristor 55 is rendered operative or inoperative in conformity with the result of the comparison between VIN and Vref 2, whereby the temperature of the heater 11 is controlled so as to be kept at the set value T2. Accordingly, the temperature is lowered even if the recording sheet 9 is on the heater 11 and therefore, the deformation of the recording sheet 9 can be minimized.

FIG. 4 is a flow chart showing the heater temperature control of the present invention.

When the main switch of the recording apparatus is closed, the CPU 21 writes "H" level into the corresponding bit of the output port 30 so that the heater temperature switching signal is set to "H" (high) level (step 101). Subsequently, the timer 25 is started (step 102), and whether a printing start command has been put out within a time set by the timer 25 is checked (step 103). If the printing start command has been put out within said time, the timer 25 is reset (step 104), and the completion of printing is checked (step 105). If printing is completed, the one line feeding step 111 and the printing signal presence discriminating step 112 is executed, whereafter the program returns to the timer start when the signal is present, whereafter said process is repeated. If the printing signal is absent, printing is completed and therefore, the paper exhausting step 113 is executed.

On the other hand, if at step 103, the printing start command is not put out within the time set by the timer, the time-out of the timer is checked (step 106). If the timer is before time-out, return is made to step 103, and if the timer is time-out, advance is made to step 107, where the heater temperature switching signal is rendered into "L" (low) level (the low temperature side), and temperature control is effected so that the surface temperature of the heater is maintained at the set temperature. Under this condition, the presence or absence of the printing start command is discriminated (step 108), and if the printing start command is present, the heater temperature switching signal is set to "H" level to render the heater 11 into a high temperature (step 109). Subsequently, the completion of printing is checked at step 110, and if printing is completed, one line feeding (step 111) and discrimination of the presence or absence of the printing signal (step 112) are effected, whereafter if the printing signal is present, return is made to step 102, where the process thereafter is repetitively executed.

Figure 5:
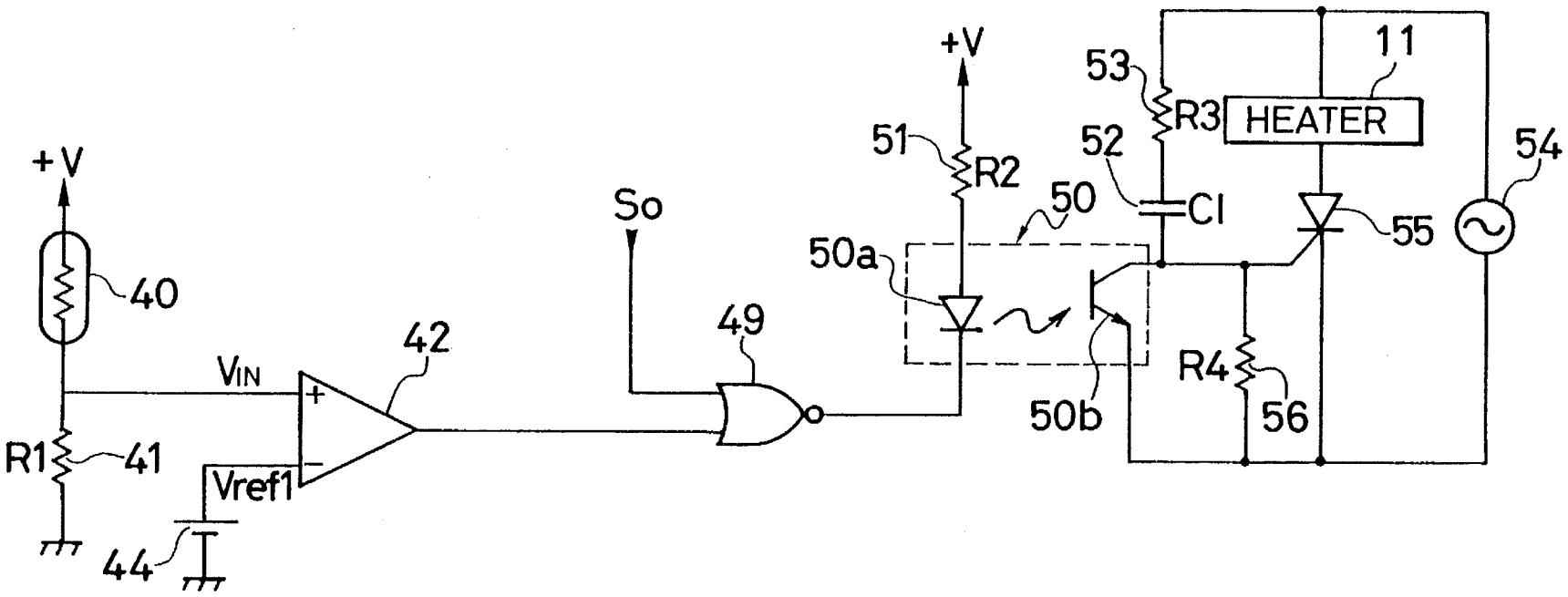
FIG. 5 is a circuit diagram showing another example of the heater temperature control unit according to the present invention.

FIG. 5 is a circuit diagram of a heater temperature control unit showing another embodiment of the present invention. The difference of this embodiment from the construction of FIG. 2 is that the comparator 43, the reference voltage source 44, the AND circuit 47 and the inverter 48 are eliminated from FIG. 2 and the output of the comparator 42 is connected to one input terminal of the NOR gate 49 and a heater ON/OFF signal So is applied to the other input terminal of the NOR gate 49.

Figure 6:
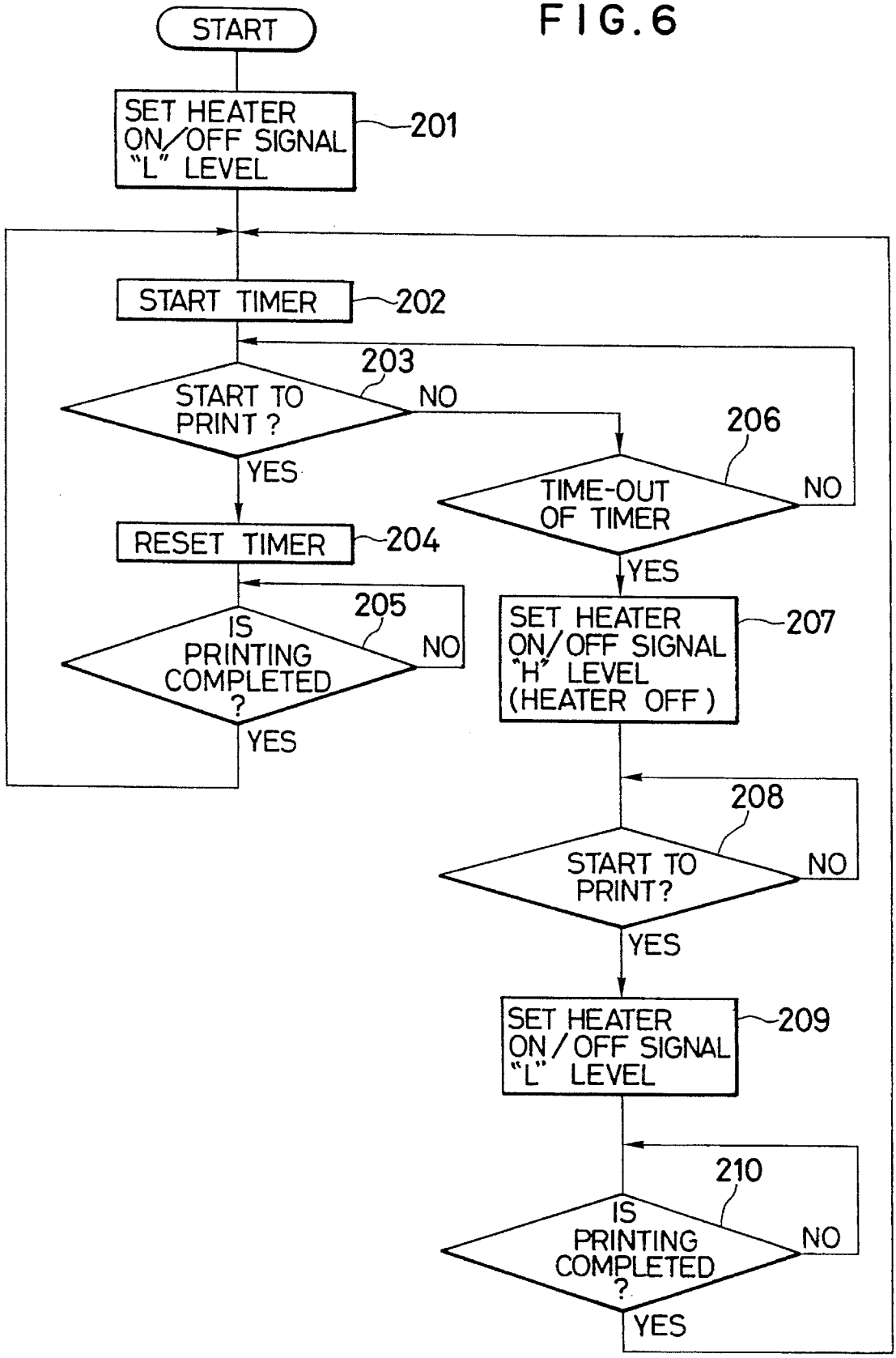
FIG. 6 is a flow chart showing the control content of the heater temperature control unit of FIG. 5.

FIG. 6 is a flow chart showing the control content of the embodiment of FIG. 5.

After the main switch of the recording apparatus is closed, the heater ON/OFF signal is set to "L" level (step 201), and then the timer 25 is started (step 202). Steps 203–205 are the same as the steps 103–105 of FIG. 4 and therefore need not be described herein.

If at step 203, the printing start command is not put out, whether the time set by the timer 25 has terminated is discriminated (step 206), and if it is before the time terminates, return is made to step 203, and if the time terminates, the heater ON/OFF signal is set to "H" level (step 207). Thereby the supply of electric power to the heater 11 is cut off and the temperature of the heater 11 is lowered, whereby the deformation of the recording sheet 9 is prevented.

When in this state, the printing start command is put out (step 208), the heater ON/OFF signal is set to "L" level (step 209) and the supply of electric power to the heater 11 is started. By the temperature of the heater 11 rising, the ink on the recording sheet 9 is rapidly dried. When the completion of printing is confirmed (step 210), the process returns to step 202, and the steps thereafter are repetitively executed.

Thus, in the embodiment of FIG. 5, the supply of electric power to the heater 11 is cut off when the recording sheet 9 exists on the heater 11 for a predetermined time or longer, and this OFF state is continued until the printing start command is put out. In the embodiment of FIG. 1, the electrically energized state and the OFF state are caused to take place alternately so that the low set temperature is maintained, whereby the vicinity of the set temperature is brought about, but the present embodiment is characterized in that the heater is kept OFF until the printing start command is put out.

As described above, according to the present invention, when the recording sheet is on the heater for a predetermined time or longer, the surface temperature of the heater is made lower than that during normal recording and therefore, the deformation or discoloring of the recording sheet can be prevented without the fixating ability of the heater during recording being spoiled.

Description will now be made of a case where the switching of the set temperature is manually effected. It is to be understood that a heater temperature switching switch 32 which will be described later is provided on a key panel provided on the outer housing of the recording apparatus of FIG. 1.

The block diagram of FIG. 4 will hereinafter be described as a block diagram using the set temperature switching switch 32 added to FIG. 4, but the description similar to the previous one will be omitted.

Data to be recorded and a command for controlling the operation of the recording apparatus are transferred from the host apparatus 20 such as a computer system to the CPU 21 through the recording data receiving portion 22 comprised of a conventional interface circuit such as a parallel interface or a serial interface.

The output signal of the heater temperature switching switch 32 provided on the key panel on the outer housing of the recording apparatus is input to the input port 29, and a heater temperature switching signal is output from the output port 30 to the heater temperature control circuit 31.

When the set heater temperature is set to the low temperature side ($T_2$) by the heater temperature switching switch 32, the heater temperature switching signal assumes "L" level. The output of AND 43 is fixed at "L" level. Accordingly, the output of the comparator 40 does not affect the output of NOR 46, but only the output of the comparator 41 determines the output of NOR 46. As a result, electric power is not supplied to the heater 11 until the temperature of the heater 11 so far controlled to a temperature $T_1$ becomes lower than $T_2$ which is a temperature lower than $T_1$. When the temperature of the heater 11 becomes lower than the temperature $T_2$, the surface temperature of the heater 11 is kept at the temperature $T_2$ by control similar to that when the temperature $T_1$ is maintained.

Figure 7:
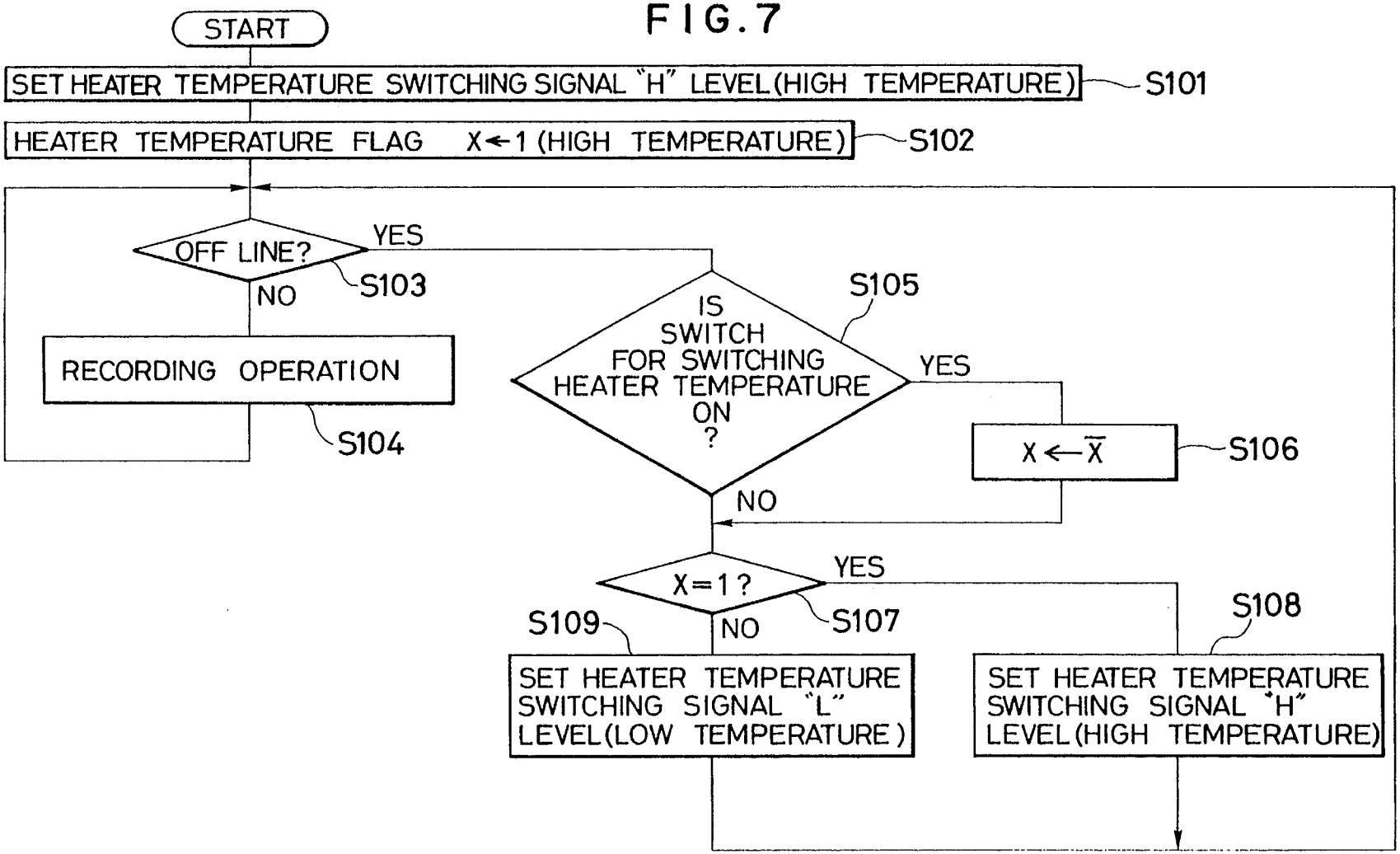
FIG. 7 is a flow chart showing the control procedure of another embodiment of the present invention.

The operation of the present embodiment constructed as described above will now be described with reference to a flow chart shown in FIG. 7.

After the main switch of the apparatus is closed, at step S101, the heater temperature switching signal is rendered into "H" level and the heater temperature is set to the high temperature side $T_1$. Subsequently, at step S102, a heater temperature flag X provided in the RAM 28 is rendered into "1".

At step S103, whether the recording apparatus is in a state capable of receiving the data from the host apparatus (an on-line state) is judged, and if the recording apparatus is in the on-line state, it receives recording data from the host apparatus and performs the recording operation at step S104, and program jumps to step S103. As long as such an on-line state continues, the heater temperature is kept at the high temperature side ($T_1$).

If at step S103, it is judged that the recording apparatus is in an off-line state, advance is made to step S105, where the output of the heater temperature switching switch 32 is detected, and when the switch is depressed, at step S106, the heater temperature flag X is inverted to $\overline{X}$. If at step S105, the heater temperature switching switch 32 is not depressed, the heater temperature flag X is maintained as it is.

Subsequently, at step S107, the heater temperature flag X is detected. If X=1, the heater temperature switching signal is rendered into "H" level to thereby set the heater temperature to the high temperature side ($T_1$), and if X=0, the heater temperature switching signal is rendered into "L" level to thereby set the heater temperature to the low temperature side ($T_2$). The heater temperature is controlled in accordance with this heater temperature switching signal. At step S108 or step S109, the heater temperature is set, whereafter the program jumps to step S103. In this manner, as long as the off-line state continues, the heater temperature flag X is inverted to "1"→"0"→"1"→"0" each time the heater temperature switching switch 32 is depressed. That is, it becomes possible to switch the set surface temperature of the heater to the high temperature→the low temperature→the high temperature→the low temperature each time the heater temperature switching switch 32 provided on the key panel of the outer housing of the apparatus is depressed. Accordingly, in the case of a recording sheet that is poor in fixativeness, the high temperature side is selected, and in a high humidity condition in which the recording sheet contains a great amount of water content, the low temperature side is selected, whereby an optimum heater temperature can be set by the judgment of the operator of the recording apparatus.

In the above-described embodiments, the set heater temperature has two high and low temperature modes, but it is apparent that it is possible to use three or more modes.

Figure 8:
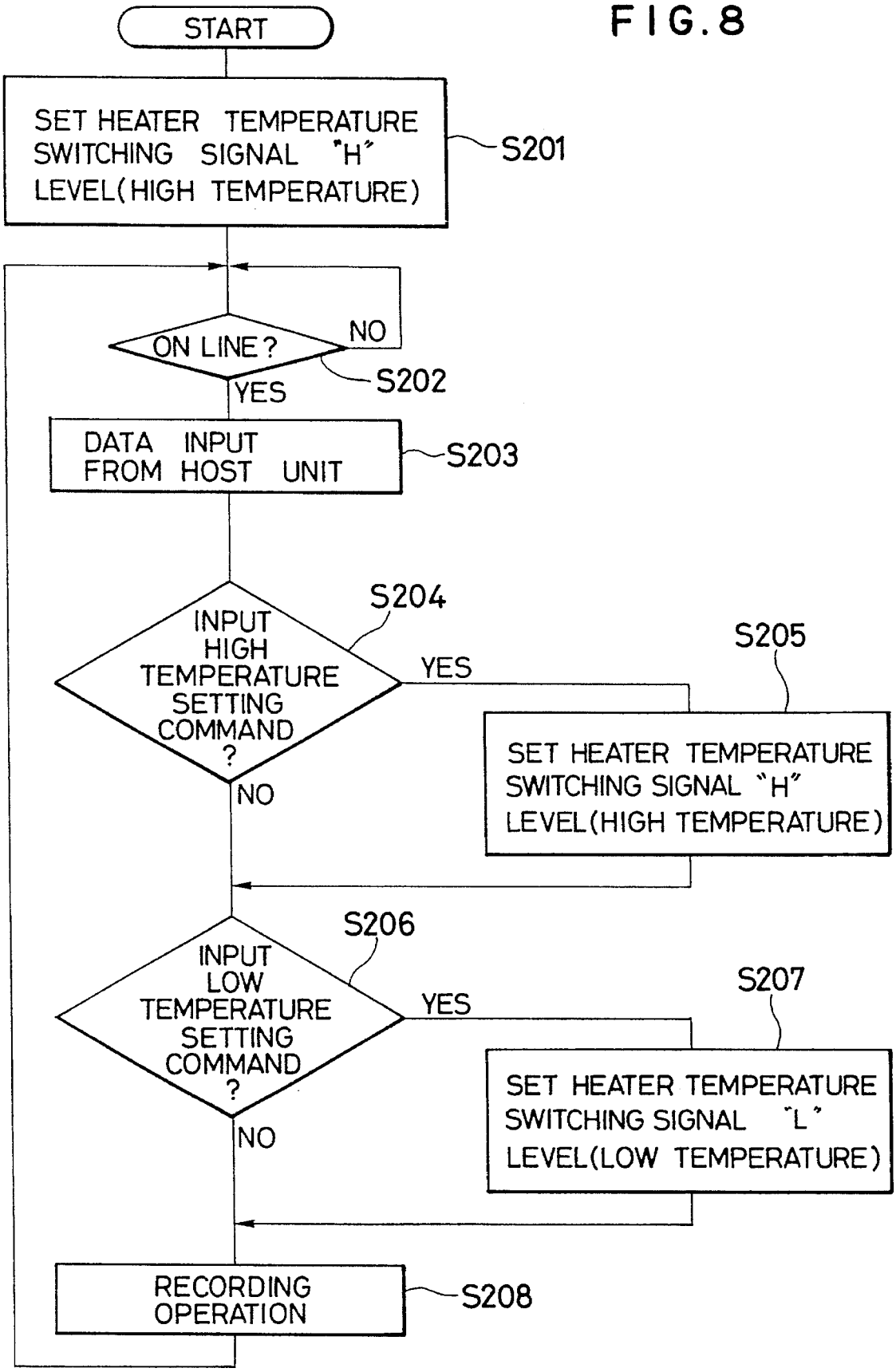
FIG. 8 is a flow chart showing the control procedure of still another embodiment of the present invention.

FIG. 8 is a flow chart showing the control procedure of the embodiment in which the switching of the set heater temperature is effected by a command from the host apparatus.

After the main switch of the apparatus is closed, at step S201, the heater temperature switching signal is rendered into "H" level so that the surface of the heater is kept on the high temperature side ($T_1$). Subsequently, at step S202, the on-line state is waited for, and data is input from the host apparatus (step S203). Whether there is a heater high temperature setting command in the input data from the host apparatus is judged at step S204, and when it is input, advance is made to step S205, where the heater temperature switching signal is set to "H" level. Also, the presence or absence of a heater low temperature setting command is judged at step S206, and when the heater low temperature setting command is input, at step S207, the heater temperature switching signal is rendered into "L" level so that the surface temperature of the heater is kept on the low temperature side ($T_2$). At the thus set surface temperature of the heater, the recording operation is performed at step S208, and the program jumps to step S202. Thereafter, a similar operation is repeated.

By effecting the above-described control, it becomes possible to set the surface temperature of the heater to two high and low temperature modes by the heater temperature setting command from the host apparatus. By increasing the kinds of the commands or the parameters, it is possible to set three or more modes of heater surface temperature. Accordingly, where the present embodiment is equipped with a cut sheet feeder, when the kind of the paper set changes in the course of the recording operation, it is possible to make such design that the kind of the paper is detected and the heater temperature is automatically changed.

Figure 11:
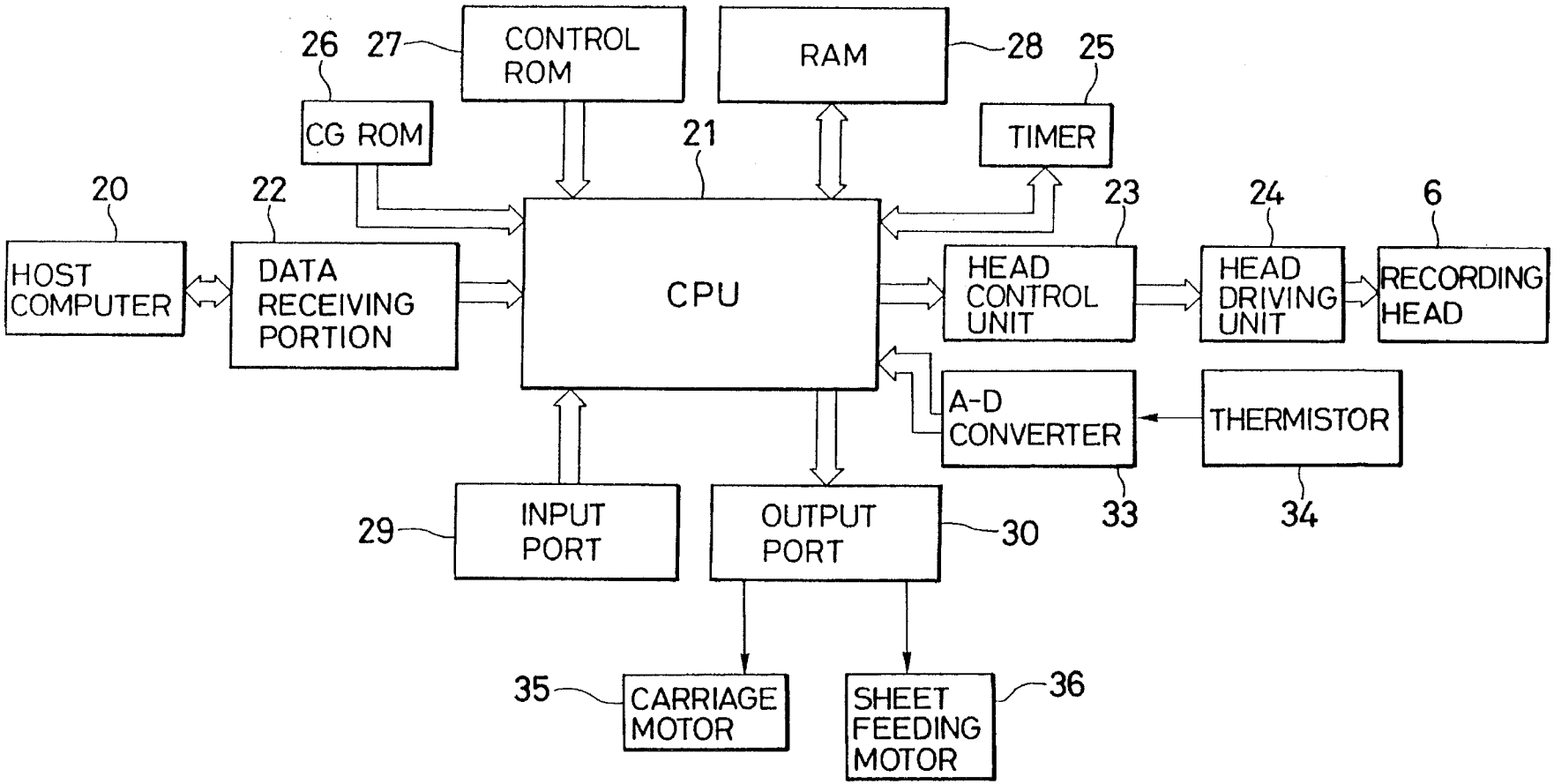
FIG. 11 is a block diagram of the control system of the recording apparatus of FIG. 1.

FIG. 11 is a block diagram of another embodiment of the control system of the recording apparatus of FIG. 1.

Portions of this block diagram which are common to those of the block diagram of FIG. 3 need not be described.

Temperature detecting means 34 comprising a thermistor or the like is mounted on the head 1, and detects the temperature during the recording operation of the head 1, and the detection signal thereof is input to an A–D converter 33.

The CPU 21 can read the data input to the A–D converter 33 to thereby detect the temperature of the head 1 at the resolving power by the bit number of the A–D converter.

The CPU 21 is designed to control the speed of the sheet feeding motor 36 through the output port 30 in conformity with the value of the temperature rise of the head 1 during recording.

That is, when as in solid printing or high-density printing, the density (number) of orifices (or nozzles) in the head 1 driven during a predetermined time is high (great) and the amount of ink adhering onto the sheet 9 is great, control is effected so as to lengthen the fixation time during which the sheet 9 is held on the fixating heater 11, by a method of reducing the sheet feeding speed or stopping the sheet feeding for a predetermined time, and when the driving density of the orifices is predetermined or less, sheet feeding is effected at a normal speed and fixation of the ink is effected within a normal fixation time.

Figure 12:
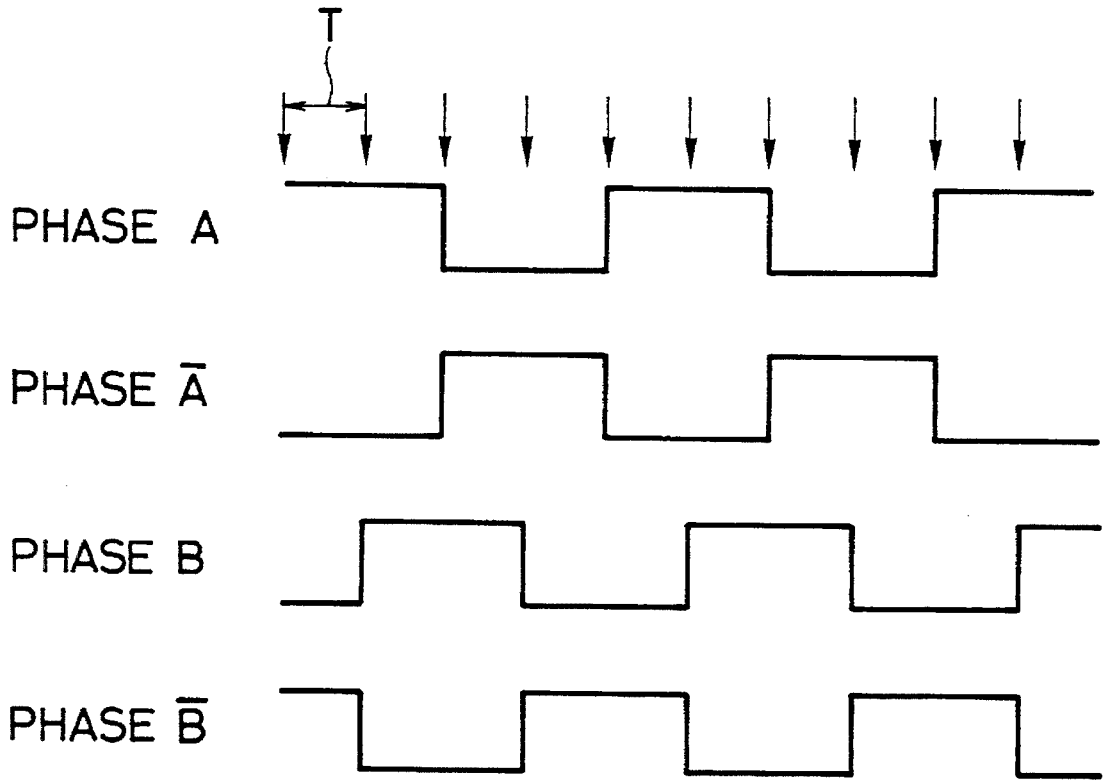
FIG. 12 is a time chart of the excitation pulse of a sheet feeding motor comprising a four-phase step motor.

FIG. 12 shows the time chart when the sheet feeding motor 36 comprising a four-phase step motor is driven by a two-phase excitation system.

In FIG. 12, a phase A, a phase $\overline{A}$, a phase B and a phase $\overline{B}$ forming four excitation phases are switched and controlled by the two-phase excitation system as shown, at the timings of respective downward arrows.

In such a sheet feeding motor 36, the spacing between the downward arrows, i.e., the period T of phase switching, can be varied to control the sheet feeding speed.

The period T of phase switching is determined by the use of a timer.

Accordingly, by varying the period T of phase switching of the sheet feeding motor 36 on the basis of the detection signal from the head temperature detecting means 34, the degree of temperature rise of the head 1 is detected in the ink jet recording apparatus according to the present invention, i.e., the ink jet recording apparatus provided with the fixating heater 11 for promoting the fixation of the ink adhering to the sheet 9, and the fixation time during which the sheet 9 is held on the fixating heater 11 can be varied by the value of the detected degree of temperature rise of the head, whereby there is provided an ink jet recording apparatus in which when the printing density is high as in solid printing, the fixation time on the heater 11 can be automatically increased without any extraneous operation and the fixativeness of the ink onto the sheet 9 can be improved.

Moreover, during the time of normal printing density (such as character printing), the heat of the heater 11 is not specially required and therefore, sheet feeding can be executed at a high speed and the actual printing speed can be improved.

Figure 9:
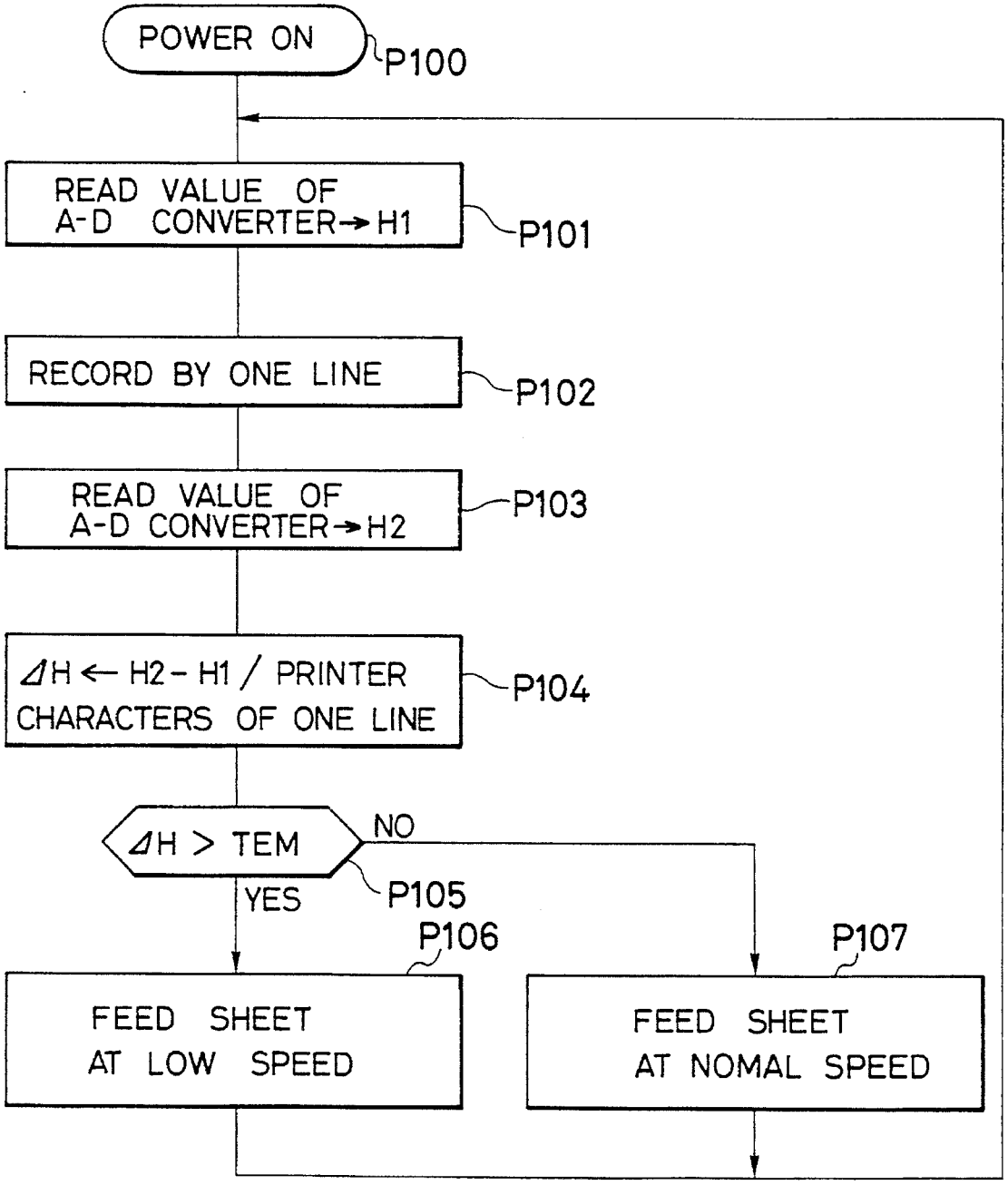
FIG. 9 is a flow chart of another embodiment of the present invention.

FIG. 9 is a flow chart showing an example of the operation of the ink jet recording apparatus according to the present invention.

In FIG. 9, at step P100, the main switch is closed, whereafter at step P101, the read value H1 of the A–D converter 32 before printing is introduced, and at step P102, one line is printed, whereafter at step P103, the read value H2 of the A–D converter 32 is introduced, and at step P104, the head temperature rise value ΔH per one character is calculated.

Then, at step P105 the temperature rise value ΔH is compared with a set value TEM.

If ΔH>TEM, it is judged that the line being currently recorded is high-density printing, and advance is made to step P106, where sheet feeding is effected at a low speed to promote the fixativeness.

On the other hand, if at step P105, ΔH≦TEM, it is judged that the line being currently recorded is not high-density printing, and advance is made to step P107, where sheet feeding is executed at a normal speed to increase the actual printing speed.

It can also be freely carried out to vary the sheet feeding speed to three or more stages, and a similar effect can also be achieved by changing the time until sheet feeding is started after recording of one line, without changing the sheet feeding speed.

Figure 10:
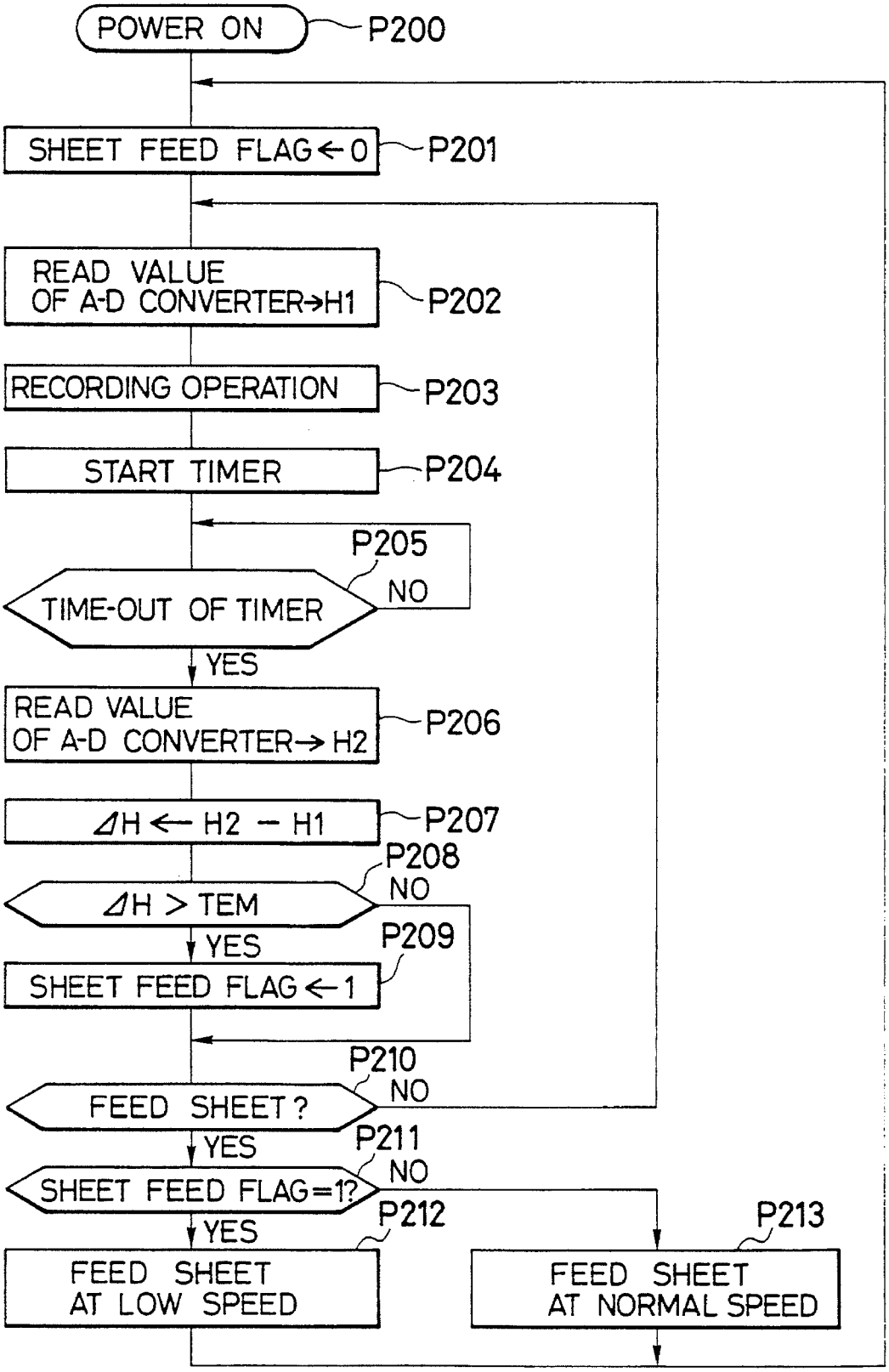
FIG. 10 is a flow chart of yet still another embodiment of the present invention.

FIG. 10 is a flow chart showing another example of the operation of the ink jet recording apparatus according to the present invention.

The control operation of FIG. 10 is such that the temperature rise of the head 1 is detected in a sampling time set by the timer 25, and in the present embodiment, by shortening the sampling time, control which freely cope with even the difference in recording density in one line can be realized.

In FIG. 10, at step P200, the main switch is closed, and at step P201, the sheet feed flag is cleared, and at step P202, the read value H1 of the A–D converter 32 is introduced, whereafter at step P203, the recording operation is started and at step P204, the timer 25 is started.

When at step P205, it is detected that the timer 25 is time-out, at step P206, the read value H2 of the A–D converter 32 is introduced, and at step P207, the degree of temperature rise ΔH=H2–H1 is calculated.

Then, at step P208, whether the degree of temperature rise ΔH has exceeded the set value TEM is discriminated, and if it exceeds the set value TEM, advance is made to step P209, where the sheet feed flag is stood (rendered into 1), whereafter at step P210 the presence or absence of a sheet feed command is discriminated.

If at step P208, the degree of temperature rise ΔH does not reach the set value TEM, advance is directly made to step P210, where the presence or absence of a sheet feed command is discriminated.

If the sheet feed command is absent, return is made to the step P202, and the above-described operations are repetitively executed.

If the sheet feed command is present, advance is made to step P211, where whether the sheet feed flag is standing (is 1) is discriminated.

If the sheet feed flag is 1, at step P212, sheet feeding is executed at a low speed to promote the fixation of the ink, and return is made to the step P201, and the above-described operations are repeated.

If the sheet feed flag is 0, advance is made to step P213, where sheet feeding is executed at a normal speed to thereby improve the actual printing speed, whereafter return is made to the step P201, and the above-described operations are repeated.

As is apparent from the foregoing description, according to the present invention, there is provided an ink jet recording apparatus provided with a fixating heater for promoting the fixation of ink adhering to a sheet and wherein the degree of temperature rise of a head is detected and the fixation time during which the sheet is held on the fixating heater is varied by the value of the detected degree of temperature rise and, therefore, when the printing density as in solid printing is high, the fixation time of the sheet on the heater can be automatically increased without any extraneous operation and the fixativeness of the ink onto the sheet can be improved.

What we claim is:

1. An ink jet recording apparatus for recording on a recording medium having two sides and being characterized by a parameter that affects deformation of the recording medium, said apparatus comprising:

a mounting section for mounting an ink jet recording head having a discharge port, the recording head depositing ink droplets in an adjacent ink recording area on one side of the recording medium, Wherein a gap is maintained between the discharge port and the recording medium;

a recording medium guide member;

conveying means for conveying the recording medium;

a mechanism for heating said recording medium guide member to heat the ink recording area for promoting the fixation of the ink to the recording medium; and means communicating with at least said conveying means for changing the rate of heat imparted to a unit length of the recording medium with respect to the direction of conveyance thereof by said heating mechanism in conformity with the parameter that affects deformation of the recording medium for preventing the recording medium from coming into contact with the discharge port, wherein deformation of the recording medium is controlled by said changing means, and wherein said changing means includes a member for manually changing a set temperature of said heating mechanism when said apparatus is in an off-line state with respect to a host.

2. An ink jet recording apparatus according to claim 1, wherein the parameter is a predetermined time during which the recording medium stops adjacent said guide member, and said changing means reduces the rate of heat imported in conformity with the lapse of the predetermined time.

3. An ink jet recording apparatus according to claim 2, wherein said changing means deenergizes said heating means in conformity with the lapse of the predetermined time.

4. An ink jet recording apparatus according to claim 1, wherein the parameter is a predetermined temperature regarding said temperature rise of the recording head.

5. An ink jet recording apparatus according to claim 4, wherein the parameter is a predetermined value regarding the temperature rise rate of the recording head, and said changing means reduces the conveyance speed of the recording medium after the completion of recording of one line.

6. An ink jet recording apparatus according to claim 1, wherein said switching means communicates with said conveying means to change a conveyance speed of the recording medium.

7. An ink jet recording apparatus according to claim 1, wherein said changing means communicates with said conveying means to change a time between a line-scan recording by the recording head on the recording medium and a start of conveyance of the recording medium.

8. An apparatus according to claim 1, wherein the rate of heat is indicative of an amount of heat.

9. An ink jet recording apparatus for recording on a recording medium having two sides, and being characterized by a parameter that affects deformation of the recording medium, said apparatus comprising:

a mounting section for mounting an ink jet recording head having a discharge port, the recording head depositing ink droplets in an adjacent ink recording area on one side of the recording medium, wherein a gap is maintained between the discharge port and the recording medium;

a recording medium guide member;

conveying means for conveying the recording medium;

a mechanism for heating said recording medium guide member to heat the ink recording area for promoting the fixation of the ink to the recording medium; and means communicating with at least said conveying means for changing the rate of heat imparted to a unit length of the recording medium with respect to the direction of conveyance thereof by said heating mechanism in conformity with the parameter that affects deformation of the recording medium for preventing the recording medium from coming into contact with the discharge port, wherein deformation of the recording medium is controlled by said changing means, and wherein the parameter relates to a stopping time of the recording medium.

10. An ink jet recording apparatus according to claim 9, wherein the parameter is supplied as a command from a host connected to said apparatus.

11. An ink jet recording apparatus according to claim 9, wherein said changing means communicates with said conveying means to change a conveyance speed of the recording medium.

12. An ink jet recording apparatus according to claim 9, wherein said changing means communicates with said conveying means to change a time between a line-scan recording by the recording head on the recording medium and a start of conveyance of the recording medium.

13. An apparatus according to claim 9, wherein the rate of heat is indicative of an amount of heat.

14. An ink jet recording apparatus operable in a character printing mode and a high-density printing mode for recording on a recording medium having two sides, said apparatus comprising:

conveying means for conveying the recording medium;

a mounting section for mounting an ink jet recording head having a discharge port, the recording head depositing ink droplets in an adjacent recording area on one side of the recording medium wherein a gap is maintained between the discharge port and the recording medium;

a heating and fixing mechanism in the vicinity of the recording area where the recording head deposits the ink droplets; and a changing means communicating with said heating and fixing mechanism and said conveying means for switching between the character printing mode and the high-density printing mode at which printing is performed with density higher than said character printing mode, said conveying means conveying the recording medium at a relatively high speed without actuating said heating and fixing mechanism while in said character printing mode and conveying the recording medium at a relatively low speed and actuating said heating and fixing mechanism while in said high-density printing mode.

15. An ink jet recording apparatus according to claim 14, wherein said switching mechanism further switches to a low-density printing mode in which printing is performed with a density higher than in said character printing mode and lower than in said high-density printing mode, and wherein in said low-density printing mode said heating and fixing mechanism is actuated and said recording medium is conveyed at a speed higher than the conveying speed of said recording medium in said high-density printing mode.

16. An ink jet recording apparatus according to claim 14, wherein the ink jet recording head includes a heater for generating thermal energy for forming a bubble to discharge ink and said switching mechanism has a manually operated switch.

17. An apparatus according to claim 14, wherein said heating and fixing mechanism imparts higher heat in the high-density printing mode than in the character printing mode.

18. An apparatus according to claim 14, wherein said conveying means causes the conveyance speed of the recording medium to be higher in the high-density printing mode than in the character printing mode.

19. An apparatus according to claim 14, wherein the rate of heat is indicative of an amount of heat.

20. An ink jet recording apparatus for recording on a recording medium having two sides and being characterized by a parameter that affects deformation of the recording medium, said apparatus comprising:

a mounting section for mounting an ink jet recording head having a discharge port, the recording head depositing ink droplets in an adjacent ink recording area on one side of the recording medium, wherein a gap is maintained between the discharge port and the recording medium;

a recording medium guide member;

conveying means for conveying the recording medium;

a mechanism for heating said recording medium guide member to heat the ink recording area for promoting the fixation of the ink to the recording medium; and means communicating with at least said conveying means for changing the rate of heat imparted to a unit length of the recording medium with respect to the direction of conveyance thereof by said heating mechanism in conformity with the parameter that affects deformation of the recording medium for preventing the recording medium from coming into contact with the discharge port, wherein deformation of the recording medium is controlled by said changing means, and wherein said changing means changes the rate of heat imparted in accordance with a control signal based on the parameter.

21. An apparatus according to claim 20, wherein the rate of heat is indicative of an amount of heat.

22. An ink jet recording apparatus operable in a character printing mode and a high-density printing mode for recording on a recording medium having two sides, said apparatus comprising:

conveying means for conveying the recording medium;

a mounting section for mounting an ink jet recording head having a discharge port, the recording head depositing ink droplets in an adjacent recording area on one side of the recording medium wherein a gap is maintained between the discharge port and the recording medium;

a heating and fixing mechanism in the vicinity of the recording area where the recording head deposits the ink droplets; and changing means communicating with either one or both of said heating and fixing mechanism and said conveying means for changing between the character printing mode and the high-density printing mode at which printing is performed with density higher than the character printing mode, wherein either one or both of said heating and fixing mechanism and said conveying means causes the rate of heat imparted to the recording medium to be higher at the high-density printing mode than at the character printing mode.

23. An apparatus according to claim 22, wherein the rate of heat is indicative of an amount of heat.

24. An ink jet recording apparatus comprising:

means for transporting an ink jet recording head along a path through a recording region;

head supporting means on one side of the path for supporting the ink jet recording head having a discharge port spaced at a predetermined distance from the recording region;

heating means arranged on another side of the path to heat the recording medium as it passes through the recording region to heat the recording medium in the recording region to promote fixing of the ink to the recording medium;

signal applying means for automatically outputting a signal indicative of at least one parameter that affects deformation of the recording material; and changing means operated in dependence upon the output from said signal supply means for determining the rate of heat imparted to a unit length of the recording medium with respect to the direction of a conveyance thereof by said heating means in conformity with the at least one parameter thereby to prevent the recording medium from coming into contact with the discharge port.

25. An apparatus according to claim 24, wherein the rate of heat is indicative of an amount of heat.

* * * * *

UNITED STATES PATENT AND TRADEMARK OFFICE

CERTIFICATE OF CORRECTION

PATENT NO. : 5,502,475 Page 1 of 2

DATED : March 26, 1996

INVENTOR(S) : Yoshiaki KABURAGI, et al.

It is certified that error appears in the above-indentified patent and that said Letters Patent is hereby corrected as shown below:

In the Drawing:

DRAWING SHEET 9 OF 12:

Figure 9, at Step P107, "NOMAL" should read --NORMAL--.

COLUMN 1:

Line 32, "796," should read --796, and--;
Line 53, "paper" should read --paper,--.

COLUMN 3:

Line 18, "particularly" should read --particularly,--;
Line 19, "the," should read --the--.

COLUMN 7:

Line 19, "a" should read --at a--.

UNITED STATES PATENT AND TRADEMARK OFFICE

CERTIFICATE OF CORRECTION

PATENT NO. : 5,502,475 Page 2 of 2

DATED : March 26, 1996

INVENTOR(S) : Yoshiaki KABURAGI, et al.

It is certified that error appears in the above-indentified patent and that said Letters Patent is hereby corrected as shown below:

COLUMN 13:

Line 42, "imported" should read --imparted--;
Line 58, "switching" should read --changing--.

COLUMN 14:

Line 56, "switching" should read --changing--;
Line 67, "switching mechanism" should read --changing means--.

COLUMN 15:

Line 11, "switching mechanism" should read --changing means--.

Signed and Sealed this

Twentieth Day of August, 1996

Bruce Lehman

*Attest:*

BRUCE LEHMAN

*Attesting Officer*

*Commissioner of Patents and Trademarks*